US012723582B2

(12) United States Patent
Fabig

(10) Patent No.: US 12,723,582 B2
(45) Date of Patent: Sep. 1, 2026

(54) DIAPHRAGM PUMP

(71) Applicant: Thomas GmbH, Herdorf (DE)

(72) Inventor: Thomas Fabig, Nauroth (DE)

(73) Assignee: Thomas GmbH, Herdorf (DE)

( * ) Notice: Subject to any disclaimer, the term of this patent is extended or adjusted under 35 U.S.C. 154(b) by 0 days.

(21) Appl. No.: 18/860,531

(22) PCT Filed: Apr. 24, 2023

(86) PCT No.: PCT/EP2023/060559
§ 371 (c)(1),
(2) Date: Oct. 25, 2024

(87) PCT Pub. No.: WO2023/208793
PCT Pub. Date: Nov. 2, 2023

(65) Prior Publication Data

US 2025/0290500 A1 Sep. 18, 2025

(30) Foreign Application Priority Data

Apr. 28, 2022 (DE) ..... 102022110332.3

(51) Int. Cl.
*F04B 43/04* (2006.01)

(52) U.S. Cl.
CPC ..... *F04B 43/04* (2013.01)

(58) Field of Classification Search
CPC ..... F04B 43/04; F04B 43/045; F04B 45/041
See application file for complete search history.

(56) References Cited

U.S. PATENT DOCUMENTS 4,286,932 A * 9/1981 Nagano ..... F04B 45/043 92/100
4,430,048 A 2/1984 Fritsch
2008/0240942 A1 10/2008 Heinrich et al.
2017/0218758 A1* 8/2017 Bachmaier ..... F01B 3/0023
(Continued)

FOREIGN PATENT DOCUMENTS

CH 281847 A 3/1952
DE 102007014709 A1 9/2008
(Continued)

OTHER PUBLICATIONS

International Search Report and of the ISA issued in PCT/EP2023/060559, mailed Jul. 17, 2023; ISA/EP.

*Primary Examiner* — Kenneth J Hansen
(74) *Attorney, Agent, or Firm* — Harness, Dickey & Pierce, P.L.C.

(57) ABSTRACT

The system relates to a diaphragm pump, comprising an intake port for receiving fluid, a discharge port for outputting fluid, a first pump chamber, a second pump chamber separated from the first pump chamber, a diaphragm, which at least partly separates the first pump chamber from the second pump chamber, wherein the first pump chamber and the second pump chamber each have a connection both to the intake port and to the discharge port, said connection being suitable for fluid communication, and wherein at least one valve is provided, which prevents fluid flow from the first pump chamber and the second pump chamber to the intake port and prevents fluid flow from the discharge port to the first pump chamber and the second pump chamber.

9 Claims, 3 Drawing Sheets

(56) References Cited

U.S. PATENT DOCUMENTS

| | | | | |
|---|---|---|---|---|
| 2018/0223826 | A1 | 8/2018 | Jeon | |
| 2021/0285436 | A1* | 9/2021 | Fukami | F04B 45/043 |
| 2021/0301810 | A1 | 9/2021 | Maltry | |

FOREIGN PATENT DOCUMENTS

| | | | |
|---|---|---|---|
| DE | 102007017731 | A1 | 10/2008 |
| DE | 112011105500 | T5 | 5/2014 |
| DE | 102014218981 | A1 | 5/2015 |
| DE | 102014008321 | B3 | 9/2015 |
| DE | 102020108235 | A1 | 9/2021 |
| EP | 0055467 | A1 | 7/1982 |
| WO | WO-00/45673 | A1 | 8/2000 |
| WO | WO-2013017143 | A1 | 2/2013 |
| WO | PCT/EP2023/060559 | | 4/2023 |

* cited by examiner

DIAPHRAGM PUMP

CROSS-REFERENCE TO RELATED APPLICATIONS

This application is a National Stage of International Application No. PCT/EP2023/060559, filed Apr. 24, 2023, which claims the benefit of and priority to German Patent Application DE 102022110332.3, filed Apr. 28, 2022. The entire disclosures of the above applications are incorporated by reference herein.

FIELD

The invention relates to a diaphragm pump. In particular, the diaphragm pump allows for improved fluid conveyance.

BACKGROUND

This section provides background information related to the present disclosure which is not necessarily prior art.

Diaphragm pumps are known from the prior art. These pumps have a pump chamber, the volume of which can be varied by a diaphragm. By displacing the diaphragm, the work steps "suction" and "compression/discharge" can be carried out successively. The displacement of the diaphragm is achieved, for example, by a fluid acting as the force transmission medium on the side of the diaphragm opposite the pump chamber or by a mechanical force transmission element.

SUMMARY

This section provides a general summary of the disclosure, and is not a comprehensive disclosure of its full scope or all of its features.

The system provides a diaphragm pump that exhibits improved fluid conveyance.

The diaphragm pump allows fluid conveyance with reduced pulsation. This is achieved, in particular, due to the fact that the work steps "suction" and "compression/discharge" are carried out simultaneously. This is accomplished by a single diaphragm. As a result, the installation space required by the diaphragm pump is also minimized. In addition, the diaphragm pump can be used easily and with minimal effort to generate a differential pressure. Overall, the diaphragm pump can be used for conveying and/or compressing and/or dosing fluids.

The diaphragm pump has a suction port for receiving fluid and a discharge port for releasing fluid. These are interfaces of the diaphragm pump that are designed for fluid connection of the diaphragm pump to other components. The suction port or the discharge port can also be open to the environment, allowing fluid to be drawn from the surroundings or discharged to the surroundings.

Furthermore, the diaphragm pump has a first pump chamber and a second pump chamber which is separate from the first pump chamber. Furthermore, a diaphragm is provided that separates the first pump chamber from the second pump chamber at least partially. The diaphragm is therefore in contact with a volume of both the first pump chamber and the second pump chamber. When the diaphragm is displaced, a volume change occurs simultaneously in the first pump chamber and the second pump chamber, wherein the volume changes in the first pump chamber and the second pump chamber are opposed to one another. This means, in particular, that the volume of the first pump chamber increases by the same amount as the volume of the second pump chamber decreases when the diaphragm is displaced, and vice versa. In this way, a suction step can be carried out simultaneously with a discharge or compression step. This kind of configuration also has the advantage that the diaphragm pump can be operated very energy-efficiently, as the displacement of the diaphragm is used for fluid conveyance on both sides of the diaphragm. If there were only a pump chamber on one side of the diaphragm, as is known in diaphragm pumps from the prior art, the displacement work on the side adjacent to the pump chamber would remain unused when the diaphragm is displaced. Therefore, in the previously described diaphragm pump, energy-efficiency is increased compared with conventional diaphragm pumps.

The first pump chamber and the second pump chamber each have a connection suitable for fluid communication with both the suction port and the discharge port. Consequently, the first pump chamber is connected to both the suction port and the discharge port. The second pump chamber is also connected to both the suction port and the discharge port. The previously used wording that a connection suitable for fluid communication is provided, should be taken to mean, in particular, that the aforementioned connection can be interrupted, for example by valves, but a state can be achieved in which there is, or can be, a fluid flow between the respective connection and the respective pump chamber. At least one valve is therefore provided that prevents a fluid flow from each of the first pump chamber and the second pump chamber to the suction port, as well as a fluid flow from the discharge port to each of the first pump chamber and the second pump chamber. This means that fluid can only flow from the suction port to the first pump chamber and the second pump chamber, but not in the reverse direction, i.e. from the first pump chamber and the second pump chamber to the suction port. This applies similarly to the discharge port, for which it is provided that fluid can only flow from the first pump chamber and the second pump chamber to the discharge port, but not from the discharge port to the first pump chamber and the second pump chamber.

According to the system, only a single valve may be provided, in particular a multi-way valve, which allows and prevents the aforementioned fluid flows. For this purpose, the valve may be appropriately switched, for example. Multiple valves can also be provided that allow and prevent the aforementioned fluid flows.

Due to the structure of the diaphragm pump described above, fluid can be simultaneously drawn in via the suction port and expelled via the discharge port, as a result of which the aforementioned advantages can be achieved. The diaphragm pump therefore achieves increased delivery performance with reduced fluid pulsation, even with a potentially small installation space. The energy used to operate the diaphragm pump is utilized more efficiently in this case.

It is provided that the first pump chamber is fluidically connected to the suction port via a first inlet valve. The first inlet valve in this case prevents a fluid flow from the first pump chamber to the suction port. Alternatively or in addition, the first pump chamber is fluidically connected to the discharge port via a first outlet valve. In this case, the first outlet valve prevents a fluid flow from the discharge port to the first pump chamber. Furthermore, alternatively or in addition, it is provided that the second pump chamber is fluidically connected to the suction port via a second inlet valve. The second inlet valve in this case prevents a fluid flow from the second pump chamber to the suction port. Alternatively or in addition, the second pump chamber is fluidically connected to the discharge port via a second outlet valve. The second outlet valve in this case prevents a fluid flow from the discharge port to the second pump chamber. Consequently, each individual connection between the pump chambers and the connections is provided with its own valve. This allows the fluid flow into each of the pump chambers and out of each of the pump chambers to be individually controlled.

The first inlet valve and/or the first outlet valve and/or the second inlet valve and/or the second outlet valve are particularly check valves. This allows the aforementioned prevention of fluid flows to be achieved simply and effectively. Fluid flows in the desired directions, i.e. those fluid flows that are not to be prevented, are still easily enabled. In particular, no control intervention with the valves is necessary. Instead, the unwanted fluid flows are automatically prevented by the check valves. Therefore, in order to operate the diaphragm pump, it is only necessary to displace the diaphragm, while the check valves automatically control the fluid flow from the suction port to the respective pump chamber and from the respective pump chamber to the discharge port.

The first pump chamber and/or the second pump chamber are at least partially formed by a pump housing. The diaphragm is fastened to the pump housing and at least partially separates the first pump chamber from the second pump chamber. The first inlet valve and/or the first outlet valve and/or the second inlet valve and/or the second outlet valve are particularly umbrella valve seals, also known as umbrella valves. These umbrella valve seals are designed to close and open the openings of the pump housing to the suction port or discharge port. In this way, the aforementioned valves are provided simply and cost-effectively. Moreover, in this way the function as a check valve is realized easily and reliably.

In an embodiment, the diaphragm pump includes a drive designed to displace the diaphragm. The displacement of the diaphragm occurs periodically, in particular, so that a continuous fluid flow through the diaphragm pump can be achieved. The diaphragm pump is particularly designed to achieve fluid conveyance through small displacements of the diaphragm at high frequency. This leads to minimized pulsation of the conveyed fluid while still achieving high flow rates at the same time.

The drive has a rotary motor. The rotary motor is coupled with the diaphragm via an eccentric and a connecting rod linked to the eccentric and is provided to displace the diaphragm. By using the rotary motor in combination with the eccentric, linear movements of the connecting rod can easily be achieved, wherein low amplitudes and high frequencies of movement of the connecting rod, and therefore the diaphragm, can be achieved, in particular. The diaphragm pump can be actuated easily and with minimal effort, as only the rotary motor needs to be rotated. An electric motor can be used as the rotary motor, which has a rotatable output shaft coupled with the eccentric.

In another embodiment, it is provided that the drive has a linear motor. The linear motor is coupled with the diaphragm via a connecting rod and is provided to displace the diaphragm. The use of the linear motor eliminates the need to convert the type of motion, as is the case with rotary motors. Consequently, the use of an eccentric or similar mechanism can be dispensed with. The linear motor is to be operated in an oscillating manner, so that periodic displacement of the diaphragm is thereby achieved. The linear motor is, in particular, an oscillating magnet which is realized by a correspondingly actuated electromagnet.

The drive is shielded from fluid within the first pump chamber and/or the second pump chamber. This allows not only low-particle gases to be conveyed but also contaminated gases or liquids. The diaphragm pump is therefore versatile and flexible in its applications.

The drive is arranged within the first pump chamber and/or the second pump chamber. The drive is therefore protected from environmental influences, on the one hand, and the construction of the diaphragm pump is simplified on the other. In this arrangement, the drive can be shielded from fluid within the first pump chamber and/or the second pump chamber, as previously described. It is particularly advantageous for the drive to be completely arranged in one of the pump chambers.

It is furthermore particularly provided that, when the diaphragm is not displaced, the volume of the first pump chamber is equal in size to the volume of the second pump chamber. In a state in which the diaphragm occupies a central position between the two maximally displaced positions for generating the suction step and the discharge step, the diaphragm is, in particular, not displaced. This design of the pump chambers allows the diaphragm pump to be used for volumetric dosing of fluids.

Further areas of applicability will become apparent from the description provided herein. The description and specific examples in this summary are intended for purposes of illustration only and are not intended to limit the scope of the present disclosure.

DRAWINGS

Further details, advantages, and features of the present invention become evident from the following description of exemplary embodiments making reference to the drawings. In the drawings.

Corresponding reference numerals indicate corresponding parts throughout the several views of the drawings.

DETAILED DESCRIPTION

Example embodiments will now be described more fully with reference to the accompanying drawings.

Figure 1:
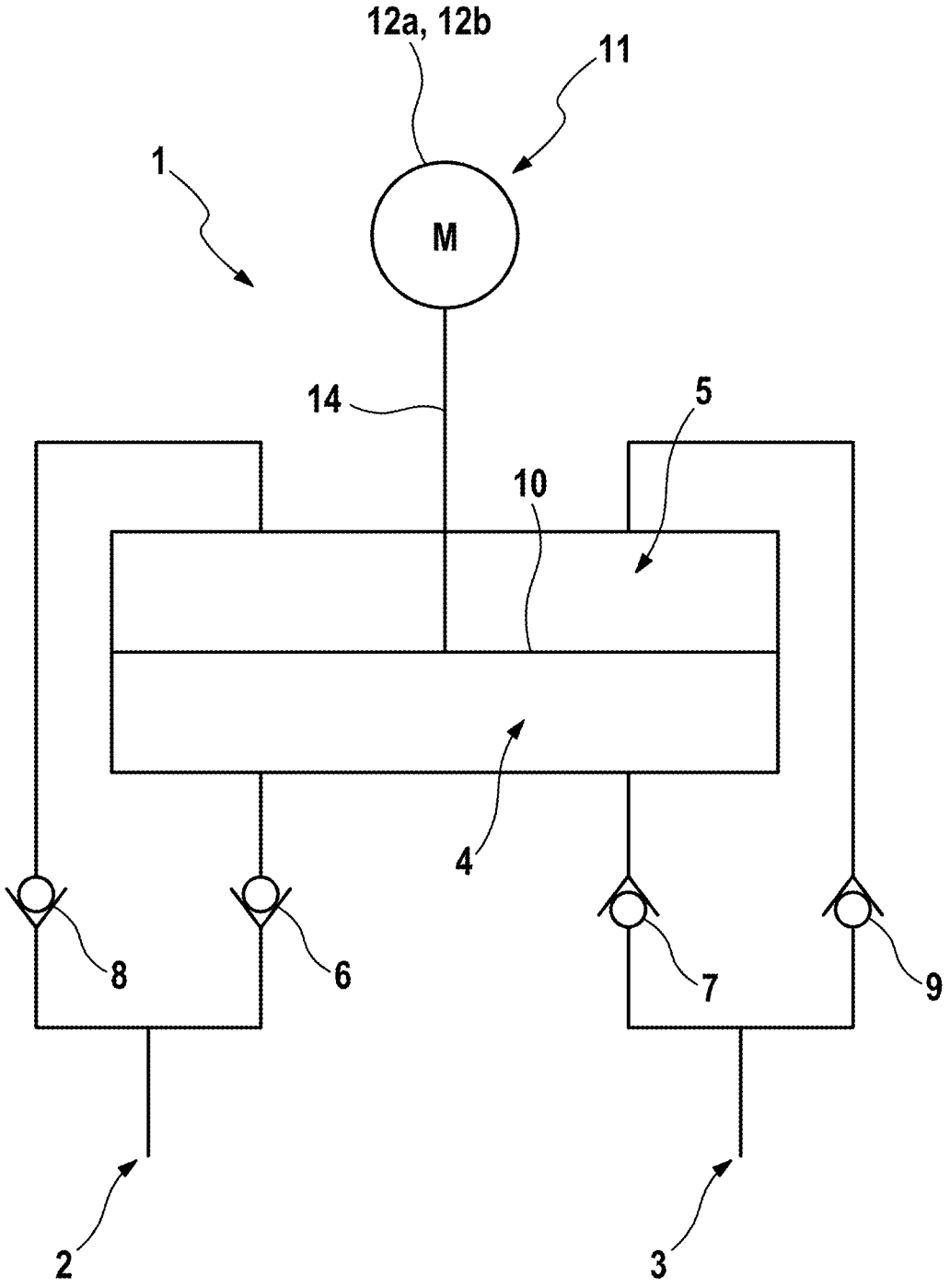
FIG. 1 shows a schematic overview of a diaphragm pump according to an exemplary embodiment of the invention.

FIG. 1 shows schematically a structure of a diaphragm pump 1 according to an exemplary embodiment. The diaphragm pump 1 has a suction port 2 and a discharge port 3. The suction port 2 serves to receive fluid, wherein the discharge port 3 is provided for expelling fluid. The diaphragm pump 1 can be connected to other components (not shown) via the suction port 2 and the discharge port 3, in order to receive fluid from these components or to deliver fluid to these components.

The diaphragm pump 1 also has a first pump chamber 4 and a second pump chamber 5, which is separated from the first pump chamber 4. In addition, the diaphragm pump 1 has a diaphragm 10 which at least partially separates the first pump chamber 4 from the second pump chamber 5. One side of the diaphragm 10 is therefore in contact with a volume of the first pump chamber 4, wherein an opposite side of the diaphragm 10 is in contact with the second pump chamber 5. When the diaphragm 10 is displaced, volume changes occur simultaneously in the first pump chamber 4 and the second pump chamber 5. If the volume of the first pump chamber 4 increases, the volume of the second pump chamber 5 decreases to the same extent. In this case, fluid is therefore drawn into the first pump chamber 4 while fluid from the second pump chamber 5 is compressed and/or expelled. The work steps "suction" and "compression/discharge" therefore take place simultaneously. Furthermore, the displacement work of the diaphragm 10 is used on both sides of the diaphragm 10 for fluid conveyance, allowing the diaphragm pump 1 to be operated very energy-efficiently, as the complete displacement work of the diaphragm, and therefore the entire energy applied—apart from unavoidable losses—is utilized for fluid conveyance.

The volume of the first pump chamber 4 and the volume of the second pump chamber 5 are preferably of equal sizes when the diaphragm 10 is not displaced. This allows for volumetric dosing of fluids by the diaphragm pump 1. Alternatively, the first pump chamber 4 and the second pump chamber 5 may also have different volumes when the diaphragm 10 is not displaced.

The first pump chamber 4 is fluidically connected to the suction port 2 via a first inlet valve 6, wherein the first inlet valve 6 prevents a fluid flow from the first pump chamber 4 to the suction port 2. The first pump chamber 4 is also fluidically connected to the discharge port 3 via a first outlet valve 7, wherein the first outlet valve 7 prevents a fluid flow from the discharge port 3 to the first pump chamber 4. A similar setup is provided for the second pump chamber 5, which is fluidically connected to the suction port 2 via a second inlet valve 8, wherein the second inlet valve 8 prevents a fluid flow from the second pump chamber 5 to the suction port 2. The second pump chamber 5 is also fluidically connected to the discharge port 3 via a second outlet valve 9, wherein the second outlet valve 9 prevents a fluid flow from the discharge port 3 to the second pump chamber 5. The first inlet valve 6, the first outlet valve 7, the second inlet valve 8 and the second outlet valve 9 are check valves.

The first inlet valve 6 and the second inlet valve 8 prevent fluid from being able to flow from the first pump chamber 4 or the second pump chamber 5 to the suction port 2. Fluid can therefore only flow from the suction port 2 into the first pump chamber 4 and into the second pump chamber 5, as a result of which a desired fluid flow direction is set. By using check valves, this fluid flow direction is automatically set when the diaphragm 10 is displaced, so that no manual valve controls are necessary. The first outlet valve 7 and the second outlet valve 9 prevent fluid from flowing from the discharge port 3 to the first pump chamber 4 or second pump chamber 5. Fluid can only flow from the first pump chamber 4 and second pump chamber 5 to the discharge port 3. Here too, the use of check valves ensures an automatic setting of the desired fluid flow direction.

When the diaphragm 10 is displaced, the volume of the second pump chamber 5 decreases simultaneously, in order to increase the volume of the first pump chamber 4. This causes fluid to be drawn into the first fluid chamber 4, which is only possible via the suction port 2 due to the first outlet valve 7. At the same time, fluid is expelled from the second pump chamber 5, which is only possible via the discharge port 3 due to the second inlet valve 8. Conversely, when the diaphragm 10 is displaced, in order to reduce the volume of the first pump chamber 4, the volume of the second pump chamber 5 is increased. This causes fluid to be expelled within the first pump chamber 4, which can only occur via the discharge port 3 due to the first inlet valve 6. At the same time, fluid is drawn into the second pump chamber 5, which is only possible via the suction port 2 due to the second outlet valve 9. A volume flow through the diaphragm pump 1 therefore takes place only from the suction port 2 to the discharge port 3, wherein each displacement of the diaphragm 10 causes simultaneous suction and expulsion. In this way, the diaphragm pump 1 can convey fluid with low pulsation and/or generate differential pressures.

The displacement of the diaphragm 10 is performed via a drive 11, for example via a connecting rod 14 that is coupled with the diaphragm 10, in the exemplary embodiment shown. The connecting rod 14 is particularly moved in an oscillating manner, in order to achieve periodic displacement of the diaphragm 10. The oscillating movement of the connecting rod 14 can be achieved in various ways. For example, a linear motor 12*b* can be used which is coupled to the connecting rod 14, in order to generate the oscillating movement. Alternatively, a rotary motor 12*a* can also be used, the rotational movement of which is converted into a linear movement, for example via an eccentric 13 (cf. FIGS. 2 and 3).

The diaphragm 10 is displaced at low amplitude but at a high frequency. This allows for a desired volume flow and/or a desired differential pressure to be achieved. In particular, pump chambers 4 and 5 with small volumes can be used, leading to a small installation space required by the diaphragm pump 1.

Figure 2:
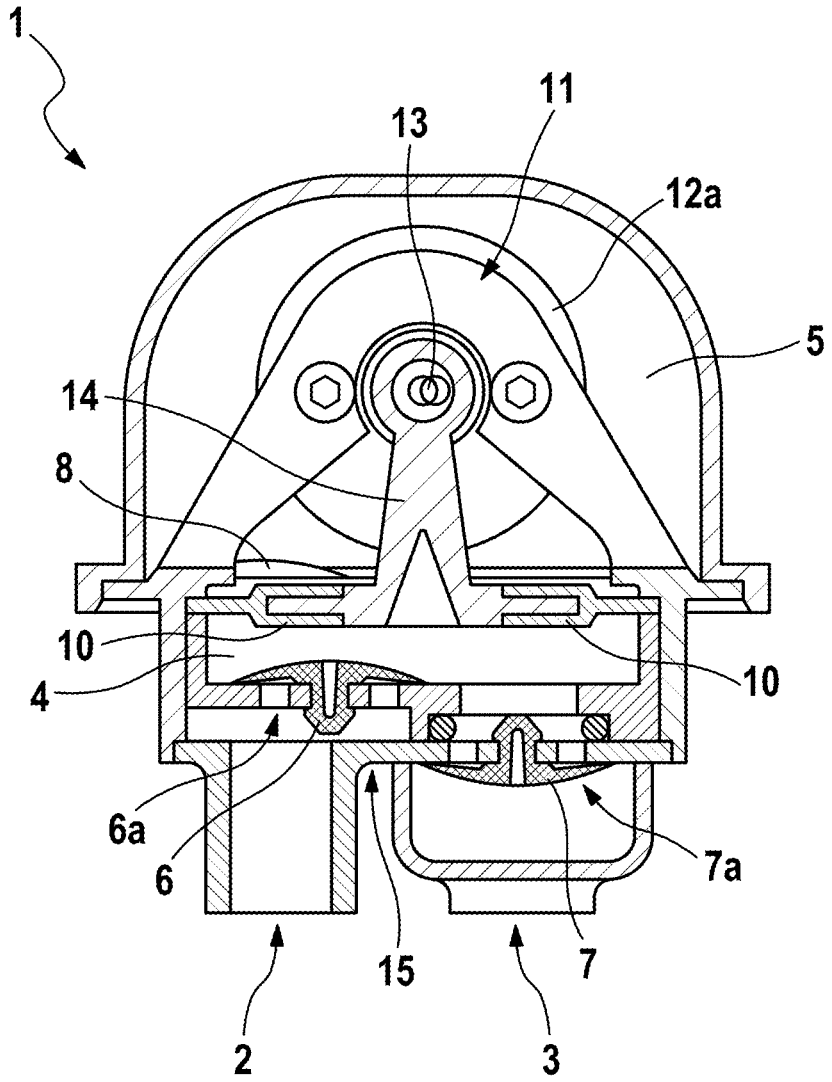
FIG. 2 shows a first schematic sectional view of the diaphragm pump according to the exemplary embodiment of the invention.
Figure 3:
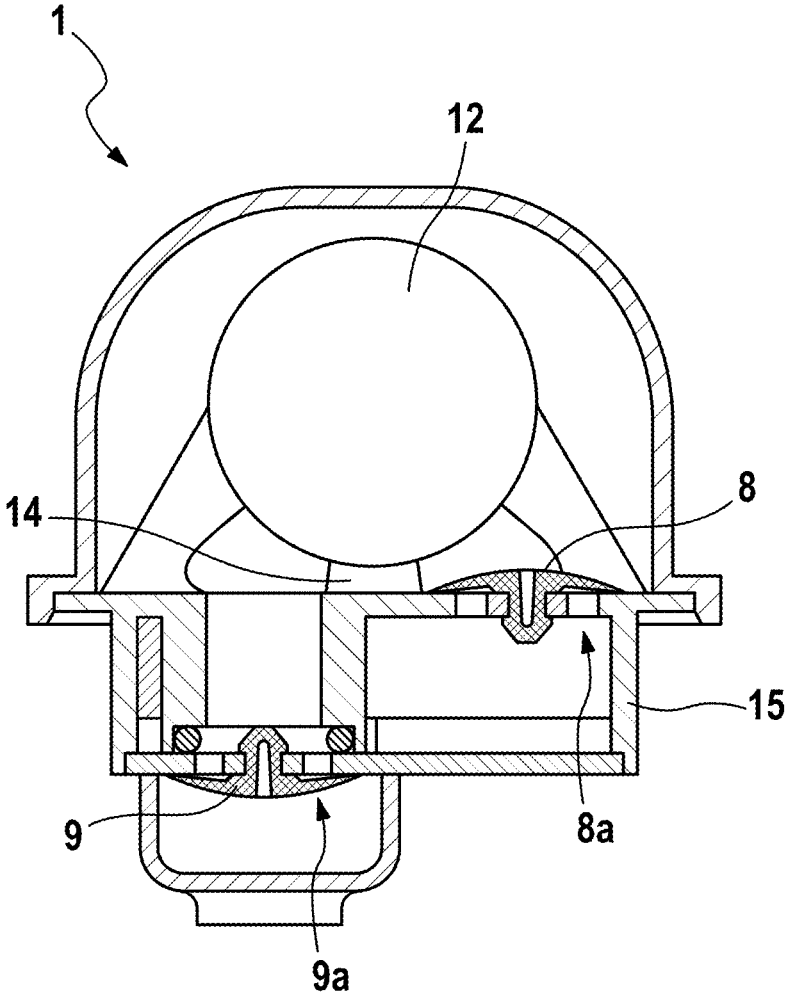
FIG. 3 shows a second schematic sectional view of the diaphragm pump according to the exemplary embodiment of the invention.

FIGS. 2 and 3 show schematic sectional views of the diaphragm pump 1 according to the exemplary embodiment. The diaphragm pump 1 has a pump housing 15 that at least partially forms the first pump chamber 4 and the second pump chamber 5. The pump housing 15 has multiple openings 6*a*, 7*a*, 8*a*, 9*a*, which establish fluid connections between the pump chambers 4, 5 and the suction port 2 and the discharge port 3. The pump housing 15 has a first inlet opening 6*a*, which connects the first pump chamber 4 to the suction port 2. A first outlet opening 7*a* of the pump housing 15 is provided for fluid connection between the first pump chamber 4 and the discharge port 3. Likewise, a second inlet opening 8*a* is provided in the pump housing 15, which establishes a fluid connection between the suction port 2 and the second pump chamber 5. Finally, a second outlet opening 9*a* is provided in the pump housing 15, which establishes a fluid connection between the discharge port 3 and the second pump chamber 5. The first inlet opening 6*a*, the first outlet opening 7*a*, the second inlet opening 8*a* and the second outlet opening 9*a* can each be formed by a single through-opening or by multiple through-openings in the pump housing 15. The associated valves 6, 7, 8, 9 are designed as umbrella valve seals at the corresponding openings 6*a*, 7*a*, 8*a*, 9*a*.

It is therefore provided that the first inlet valve 6, as an umbrella valve seal, covers the first inlet opening 6*a*, the first outlet valve 7, as an umbrella valve seal, covers the first outlet opening 7*a*, the second inlet valve 8, as an umbrella valve seal, covers the second inlet opening 8*a*, and the second outlet valve 9, as an umbrella valve seal, covers the second outlet opening 9*a*. The configuration as an umbrella valve seal allows for a simple and reliable implementation of check valves.

In the examples shown in FIGS. 2 and 3, the drive 11 is arranged within the second pump chamber 5. It is particularly advantageous that the drive 11 is shielded from a fluid within the second pump chamber 5. Consequently, in addition to low-particle gases, contaminated gases and liquids can also be conveyed. In an alternative embodiment, the drive 11 can also be arranged outside the pump chambers 4, 5 or within the first pump chamber 4.

The diaphragm pump 1 according to the exemplary embodiment can y be used for conveying and/or compressing and/or dosing fluids. The diaphragm pump 1 can be used particularly advantageously when high flow outputs are conveyed at low differential pressures. The diaphragm pump 1 can also be used when only a small installation space is available and/or when low pulsation and low noise emission are desired. For example, and not limited to, the diaphragm pump 1 can be used in tank leak diagnosis modules and/or dosing systems in internal combustion engines and/or small fuel cells and/or for conveying and distributing aerosols and/or as air pumps in aquariums.

In addition to the written description of the invention above and for supplementary disclosure thereof, explicit reference is hereby made to the graphical representation of the invention in FIGS. 1 to 3.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE SIGNS

1 diaphragm pump
2 suction port
3 discharge port
4 first pump chamber
5 second pump chamber
6 first inlet valve
6*a* first inlet opening
7 first outlet valve
7*a* first outlet opening
8 second inlet valve
8*a* second inlet opening
9 second outlet valve
9*a* second outlet opening
10 diaphragm
11 drive
12*a* rotary motor
12*b* linear motor
13 eccentric
14 connecting rod
15 pump housing

The invention claimed is:

1. A diaphragm pump comprising:
a suction port for receiving fluid;
a discharge port for releasing fluid;
a first pump chamber;
a second pump chamber separate from the first pump chamber;
a single diaphragm that separates the first pump chamber from the second pump chamber at least partially, a first side of the single diaphragm in contact with a first volume of the first pump chamber and an opposed second side of the single diaphragm in contact with a second volume of the second pump chamber;
a drive configured to displace the diaphragm;
wherein the first pump chamber and the second pump chamber each have a connection suitable for fluid communication with both the suction port and the discharge port;
wherein at least one inlet valve is provided that prevents a fluid flow from each of the first pump chamber and the second pump chamber to the suction port, and at least one outlet valve is provided that prevents a fluid flow from the discharge port to each of the first pump chamber and the second pump chamber;
wherein the drive is arranged within the first pump chamber and/or the second pump chamber.

2. The diaphragm pump as claimed in claim 1, wherein
the at least one inlet valve includes a first inlet valve and a second inlet valve,
the at least one outlet valve includes a first outlet valve and a second outlet valve,
the first pump chamber is fluidically connected to the suction port via the first inlet valve, wherein the first inlet valve prevents a fluid flow from the first pump chamber to the suction port, and/or
the first pump chamber is fluidically connected to the discharge port via the first outlet valve, wherein the first outlet valve prevents a fluid flow from the discharge port to the first pump chamber, and/or
the second pump chamber is fluidically connected to the suction port via the second inlet valve, wherein the second inlet valve prevents a fluid flow from the second pump chamber to the suction port, and/or
the second pump chamber is fluidically connected to the discharge port via the second outlet valve, wherein the second outlet valve prevents a fluid flow from the discharge port to the second pump chamber.

3. The diaphragm pump as claimed in claim 2, wherein the first inlet valve and/or the first outlet valve and/or the second inlet valve and/or the second outlet valve are check valves.

4. The diaphragm pump as claimed in claim 3, wherein the first pump chamber and/or the second pump chamber are at least partially formed by a pump housing, wherein the first inlet valve and/or the first outlet valve and/or the second inlet valve and/or the second outlet valve are umbrella valve seals that close and open openings of the pump housing to the suction port or discharge port.

5. The diaphragm pump as claimed in claim 1, wherein the drive is designed for periodic displacement, of the single diaphragm.

6. The diaphragm pump as claimed in claim 1, wherein the drive has a rotary motor that is coupled with the single diaphragm via an eccentric and a connecting rod linked to the eccentric and is provided to displace the single diaphragm.

7. The diaphragm pump as claimed in claim 1, wherein the drive has a linear motor which is coupled with the single diaphragm via a connecting rod and is provided to displace the single diaphragm.

8. The diaphragm pump as claimed in claim 1, wherein the drive is shielded from fluid within the first pump chamber and/or the second pump chamber.

9. The diaphragm pump as claimed in claim 1, wherein when the single diaphragm is not displaced, the volume of the first pump chamber is equal in size to the volume of the second pump chamber.

* * * * *